US005529665A

United States Patent [19]

Kaun

[11] Patent Number: 5,529,665

[45] Date of Patent: Jun. 25, 1996

[54] METHOD FOR MAKING SOFT TISSUE USING CATIONIC SILICONES

[75] Inventor: James M. Kaun, Neenah, Wis.

[73] Assignee: Kimberly-Clark Corporation, Neenah, Wis.

[21] Appl. No.: 287,638

[22] Filed: Aug. 8, 1994

[51] Int. Cl.[6] ..... D21H 21/22

[52] U.S. Cl. ..... 162/111; 162/112; 162/113; 162/127; 162/129; 162/130; 162/149; 162/158; 162/164.4

[58] Field of Search ..... 162/111, 112, 162/113, 158, 164.4, 127, 129, 130, 149, 181.6

[56] References Cited

U.S. PATENT DOCUMENTS

| | | | |
|---|---|---|---|
| 2,926,116 | 2/1960 | Keim | 162/164 |
| 3,058,873 | 10/1962 | Keim et al. | 162/164 |
| 4,406,738 | 9/1983 | Fink et al. | 162/164.4 |
| 4,501,640 | 2/1985 | Soerens | 162/111 |
| 4,528,316 | 7/1985 | Soerens | 524/503 |
| 4,950,545 | 8/1990 | Walter et al. | 428/446 |
| 5,059,282 | 10/1991 | Ampulski et al. | 162/112 |
| 5,164,046 | 11/1992 | Ampulski et al. | 162/112 |
| 5,227,242 | 7/1993 | Walter et al. | 428/446 |
| 5,246,545 | 9/1993 | Ampulski et al. | 162/112 |

FOREIGN PATENT DOCUMENTS

| | | | |
|---|---|---|---|
| 0347153 | 12/1989 | European Pat. Off. | D21H 3/62 |
| 0394689 | 10/1990 | European Pat. Off. | D06M 15/643 |

*Primary Examiner*—Peter Chin
*Attorney, Agent, or Firm*—Gregory E. Croft

[57] ABSTRACT

The addition of a relatively small amount of a cationic silicone to the aqueous suspension of papermaking fibers in the wet end of the tissue making process provides improved tactile properties (softness) to the resulting tissue.

10 Claims, 5 Drawing Sheets

METHOD FOR MAKING SOFT TISSUE USING CATIONIC SILICONES

BACKGROUND OF THE INVENTION

In the manufacture of soft tissues, such as facial and bath tissues, the industry has continually improved the tactile characteristics of the products to meet the needs and desires of consumers. One means for improving the feel of tissues is to incorporate an additive into the tissue, including a silicone such as a polysiloxane. The term "silicone" includes a wide range of products having chains of silicon atoms as their core structure. Different properties are achieved by the attachment of selected chemical functional groups to the silicone backbone. The resulting structures are commonly referred to as polysiloxane, polydimethylsiloxane, or polydiorganosiloxanes. Silicones are usually hydrophobic and can be obtained as neat fluids, organic solvent solutions, or as water emulsions. These emulsions can have a positive, neutral, or negative charge. The size of the emulsion particle can also be adjusted from about 50 nanometers (microemulsions) to about 1 micron. Silicones can be supplied as a fluid, but these usually have low solubility in water unless an additional functional group is used to add hydrophilic character.

Silicones are known to provide a desireable smooth or silky feeling to the surface of the tissue and thereby improve perceived softness. Typically silicones are applied to the tissue web at some point after it is formed, either before or after drying, by spraying or printing the silicone onto the surface of the tissue. While such methods are effective, they require a capital investment in spraying or printing equipment to apply the silicone. Also, the silicones themselves are expensive and a significant amount of silicone is generally required to impart the desired properties to the tissue. Add-on amounts typically range from about 1–2 dry weight percent based on the weight of the fibers.

The concept of adding silicones to the wet end of the tissue making process has been previously considered because of its simplicity and attendant avoidance of capital equipment. But when used in significant amounts as are ordinarily required by spraying or printing, the silicone wreaks havoc with the downstream creping operation by preventing adequate adhesion of the sheet to the dryer surface and thereby causing the sheet to flare off of the dryer. In addition, the silicone rapidly builds up in the wet end water system, which must be disposed, resulting in the loss of the expensive silicone.

Hence there is a need for a means of incorporating silicone materials into tissues which improves the tactile properties of the tissue and which is simple and relatively inexpensive in terms of capital and materials costs.

SUMMARY OF THE INVENTION

It has now been discovered that silicones, particularly polysiloxanes, can be introduced into the wet end of the tissue making process at very low levels which are still effective in improving the softness of the resulting tissue product and which do not interfere with the creping operation. This is accomplished by using low levels of a silicone which bonds to the negatively charged sites on the surface of the cellulose fibers through a cationic charge either on the silicone itself or on the surfactant used to stabilize the colloidal particles. The creping adhesive formulation can be correspondingly adjusted to account for the presence of the silicone at high silicone addition rates. The cationic bonding can be achieved by contacting the cellulose fibers with a water soluble or water compatible cationic silicone or a silicone which has been treated with a cationic surfactant to provide positive bonding sites. Such silicones attach to the cellulose fibers and exhibit greater retention on the fiber than nonionic or anionic silicones. As a result significantly less silicone is lost to the white water system during formation of the tissue web and the silicone substantially remains in the fiber layer to which it was added. This enables the production of a soft and strong tissue sheet.

Hence in one aspect, the invention resides in a method for making a soft tissue sheet comprising the steps of (a) forming an aqueous suspension of cellulosic papermaking fibers containing from about 0.01 to about 1 dry weight percent, based on the weight of the fibers, of a cationic silicone; (b) depositing the aqueous fiber suspension onto a foraminous forming wire which retains the fibers to form a wet web; (c) dewatering or dewatering/drying the wet web; (d) adhering the web to a creping cylinder, such as a Yankee dryer, with a creping adhesive; and (e) creping the web from the creping cylinder with a creping blade to form a soft tissue.

In the case of a wet-pressing process, the tissue web can be dried on the Yankee dryer. In the case of a throughdrying process, the web can be partially dried or fully dried before being adhered to the creping cylinder, which again can be a Yankee dryer. Alternatively, the web can be throughdried and left uncreped if the cationic silicone and the fibers provide adequate softness without creping. Such uncreped throughdried tissues preferably are layered and have at least one outer layer containing predominantly hardwood fibers and a cationic silicone.

Preferably the tissue is formed as a layered tissue having a hardwood layer on the outside surface and a softwood (strength) layer on the inner surface. Since the cationic silicone in some respects acts like a debonder, the silicone is preferably added only to the outer layer hardwood furnish to improve the softness of the resulting tissue without degrading the strength of the softwood layer. In addition, it is preferred that the cationic silicone-containing hardwood layer is placed against the surface of the creping cylinder or Yankee dryer during creping so that the cationic silicone ends up on the side of the tissue which is more smooth and softer. Generally the "dryer side" of the tissue is more smooth than the opposite side (air side). The final tissue product can have one, two, three or more plies. For multi-ply products, the individual plies are preferably of a two layer construction, with the strength layer positioned inwardly and the softer hardwood layer on the outside of the product.

Hence in another aspect, the invention resides in a layered tissue sheet comprising a first layer and a second layer, wherein the first layer is an outer layer and contains predominantly hardwood fibers, such as eucalyptus fibers, and from about 0.01 to about 0.2 dry weight percent, based on the weight of the fibers in the outer layer, of a cationic silicone, and wherein said second layer contains predominantly softwood fibers.

As used herein, a "cationic silicone" is any silicone polymer or oligomer having a silicon backbone, including polysiloxanes, having a positive charge, either as a result of the silicone structure itself or as a result of being in combination with a surfactant. The silicone can be delivered to the aqueous suspension of papermaking fibers as a silicone fluid, an emulsion, a suspension, or a solid. The silicone can be unsubstituted polydimethylsiloxane or it can be a polysiloxane having substituted functional groups such as amino-, epoxy-, silanol-, quaternary nitrogen, etc.

For creped tissues, the amount of cationic silicone added to the aqueous suspension of papermaking fibers can be from about 0.01 to about 1 dry weight percent, more specifically from about 0.05 to about 0.5 dry weight percent, and still more specifically from about 0.1 to about 0.2 dry weight percent. The add-on amount can depend on the tactile properties desired, the papermaking fiber composition, and the creping adhesive composition. If the cationic silicone is added to a layer, the foregoing amounts are applicable to the specific layer. If the tissue is blended (not layered), the foregoing amounts apply to the total weight of the tissue. For uncreped tissues, the upper limit on the amount of cationic silicone added can be higher, limited primarily by economics since there is no creping step with which the silicone can interfere.

If the silicone is combined with a surfactant, suitable surfactants include those surfactants that stabilize the emulsions of the desired silicone compounds. The specific structures of these surfactants can vary widely, but must have at least some cationic character.

With regard to creping adhesive formulations useful for making creped tissues in accordance with the method of this invention, suitable creping adhesives comprise an aqueous solution of a plasticizer (referred to herein as a "release agent") and a thermosetting cationic polyamide resin, and preferably further comprise polyvinyl alcohol. The creping adhesive is applied as a solution containing from about 0.1 to about 1 percent solids, the balance being water.

Suitable thermosetting cationic polyamide resins are the water-soluble polymeric reaction product of an epihalohydrin, preferably epichlorohydrin, and a water-soluble polyamide having secondary amine groups derived from polyalkylene polyamine and a saturated aliphatic dibasic carboxylic acid containing from about 3 to 10 carbon atoms. The water soluble polyamide contains recurring groups of the formula:

$$—NH(C_nH_{2n}HN)_x—CORCO—$$

where n and x are each 2 or more and R is the divalent hydrocarbon radical of the dibasic carboxylic acid. An important characteristic of these resins is that they are phase compatible with polyvinyl alcohol. Suitable materials of this type are commercially available under the trademarks KYMENE® (Hercules, Inc.) and CASCAMID® (Borden) and are more fully described in U.S. Pat. No. 2,926,116 issued to Gerald Keim on Feb. 23, 1960, U.S. Pat. No. 3,058,873 issued to Gerald Keim et al. on Oct. 16, 1962, and U.S. Pat. No. 4,528,316 issued to Dave Soerens on Jul. 9, 1985, all of which are herein incorporated by reference. The creping adhesive also preferably includes polyvinyl alcohol. The amount of the thermosetting cationic polyamide resin in the creping composition, on a solids weight percent basis, can be from about 10 to about 80 percent, more specifically from about 20 to about 60 percent.

Suitable plasticizers or release agents include quaternized polyamino amides and sorbitol, although the plasticizing mechanism of sorbitol is likely different than that of the quaternized polyamino amides. A preferred quaternized polyamino amide is Quaker 2008, commercially available from Quaker Chemical Company. A significant amount of this release agent must be included in the creping composition in order to prevent the tissue sheet from wrapping around the dryer and to substantially prevent fibers from building up on the dryer surface. Suitable amounts of release agents in the creping adhesive composition can be from about 10 to about 40 weight percent, more specifically from about 15 to about 25 weight percent, on a solids basis.

When present, the amount of polyvinyl alcohol can be from about 1 to about 80 weight percent, more specifically from about 20 to about 60 weight percent on a solids basis.

If the tissue is creped, the dryer temperature is such that the tissue is creped from the dryer surface as dry as possible. The temperature of the tissue web when it reaches the creping blade, as measured by an infra-red temperature sensor, is about 200° F. or greater, preferably about 220° F. or greater, and more preferably about 235° F. A suitable range is from about 225° F. to about 235° F. At the same time, the moisture content of the web at the creping blade is about 3 percent or less, preferably 2.5 percent or less. A suitable range is from about 2 to 3 percent. These conditions provide for very high adhesion of the web to the dryer surface and thereby enable the creping blade to uniformly debond the sheet.

DETAILED DESCRIPTION OF THE DRAWING

Figure 1:
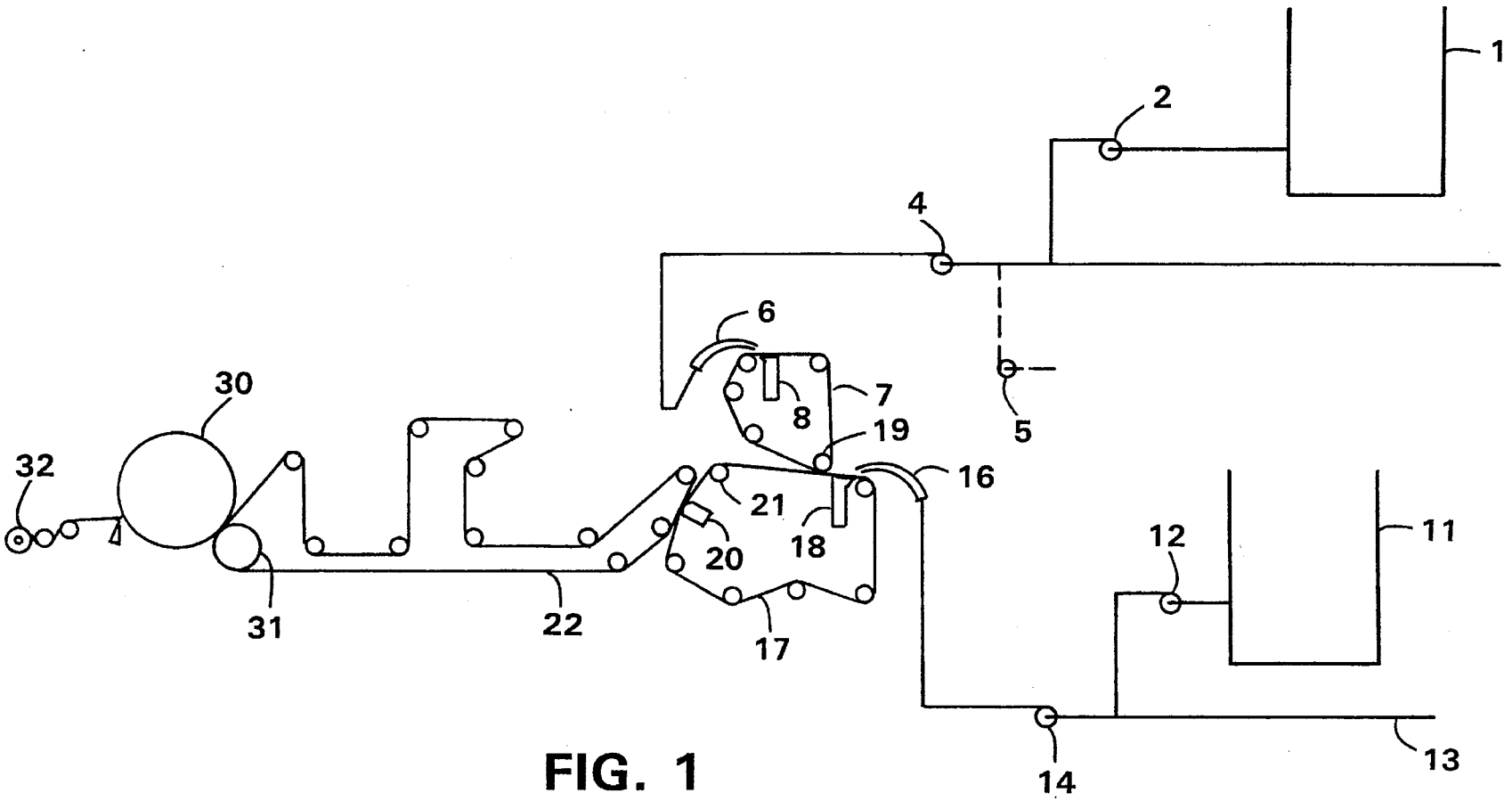
FIG. 1 is a schematic flow diagram of a tissue making process useful in accordance with this invention, in which two webs are individually formed and couched together to form a layered web.

Referring to FIG. 1, a method of making a wet-pressed tissue in accordance with this invention is described, commonly referred to as couch forming, wherein two wet webs are independently formed and thereafter combined into a unitary web. To form the first web, a specified fiber (either hardwood or softwood) is prepared in a manner well known in the papermaking arts and delivered to the first stock chest 1, in which the fiber is kept in an aqueous suspension. A stock pump 2 supplies the required amount of suspension to the suction side of the fan pump 4. A metering pump 5 supplies a chemical such as dry strength resin or silicone into the fiber suspension. Additional dilution water 3 also is mixed with the fiber suspension. The entire mixture is then pressurized and delivered to the headbox 6. The aqueous suspension leaves headbox 6 and is deposited on an endless papermaking fabric 7 over suction box 8. The suction box is under vacuum which draws water out of the suspension, thus forming the first web. In this example, the stock issuing from headbox 6 would be referred to as the "air side" layer, that layer eventually being positioned away from the dryer surface during drying.

The forming fabric can be any forming fabric, preferably having a fiber support index of about 150 or greater. Specific suitable forming fabrics include, without limitation: single layer fabrics, such as the Appleton Wire 94M available from Albany International Corporation, Appleton Wire Division, Menasha, Wis.; double layer fabrics, such as the Asten 866 available from Asten Group, Appleton, Wis.; and triple layer fabrics, such as the Lindsay 3080, available from Lindsay Wire, Florence, Miss.

The consistency of the aqueous suspension of papermaking fibers leaving the headbox can be from about 0.05 to about 2 percent, preferably about 0.2 percent. The cationic silicone can be added to the aqueous suspension of papermaking fibers at any point prior to formation of the web, such as in the stock chest or the stuff box. It is preferable that the silicone be added to the furnish layer that is placed against the dryer surface during creping, which in this case would be the layer issuing from the second headbox 16. The cationic silicone is preferably added to the hardwood fiber furnish, which preferably is used to form one or both outer layers of the tissue. The first headbox 6 can be a layered headbox with two or more layering chambers which delivers a stratified or layered first wet web, or it can be a monolayered headbox which delivers a blended or homogeneous first wet web.

To form the second web, a specified fiber (either hardwood or softwood) is prepared in a manner well known in the papermaking arts and delivered to the second stock chest 11, in which the fiber is kept in an aqueous suspension. A stock pump 12 supplies the required amount of suspension to the suction side of the fan pump 14. A metering pump 5 can alternatively supply chemical such as dry strength resin or silicone into the fiber suspension as described above. Additional dilution water 13 also is mixed with the fiber suspension. The entire mixture is then pressurized and delivered to headbox 16. The aqueous suspension leaves headbox 16 and is deposited onto an endless papermaking fabric 17 over suction box 18. The suction box is under vacuum which draws water out of the suspension, thus forming the second wet web. In this example, the stock issuing from headbox 16 is referred to as the "dryer side" layer, that layer being in eventual contact with the dryer surface. Suitable forming fabrics for the forming fabric 17 of the second headbox include those forming fabrics previously mentioned with respect to the first headbox forming fabric.

After initial formation of the first and second wet webs, the two webs are brought together in contacting relationship (couched) while at a consistency of from about 10 to about 30 percent. Whatever consistency is selected, it is preferable that the consistencies of the two wet webs be substantially the same. Couching is achieved by bringing the first wet web into contact with the second wet web at roll 19.

After the consolidated web has been transferred to the felt 22 at vacuum box 20, dewatering, drying and creping of the consolidated web is achieved in the conventional manner. More specifically, the couched web is further dewatered and transferred to a Yankee dryer 30 using a pressure roll 31, which serves to express water from the web, which is absorbed by the felt, and causes the web to adhere to the surface of the Yankee. The web is then dried, creped and wound into a roll 32 for subsequent converting into the final creped product.

Figure 2:
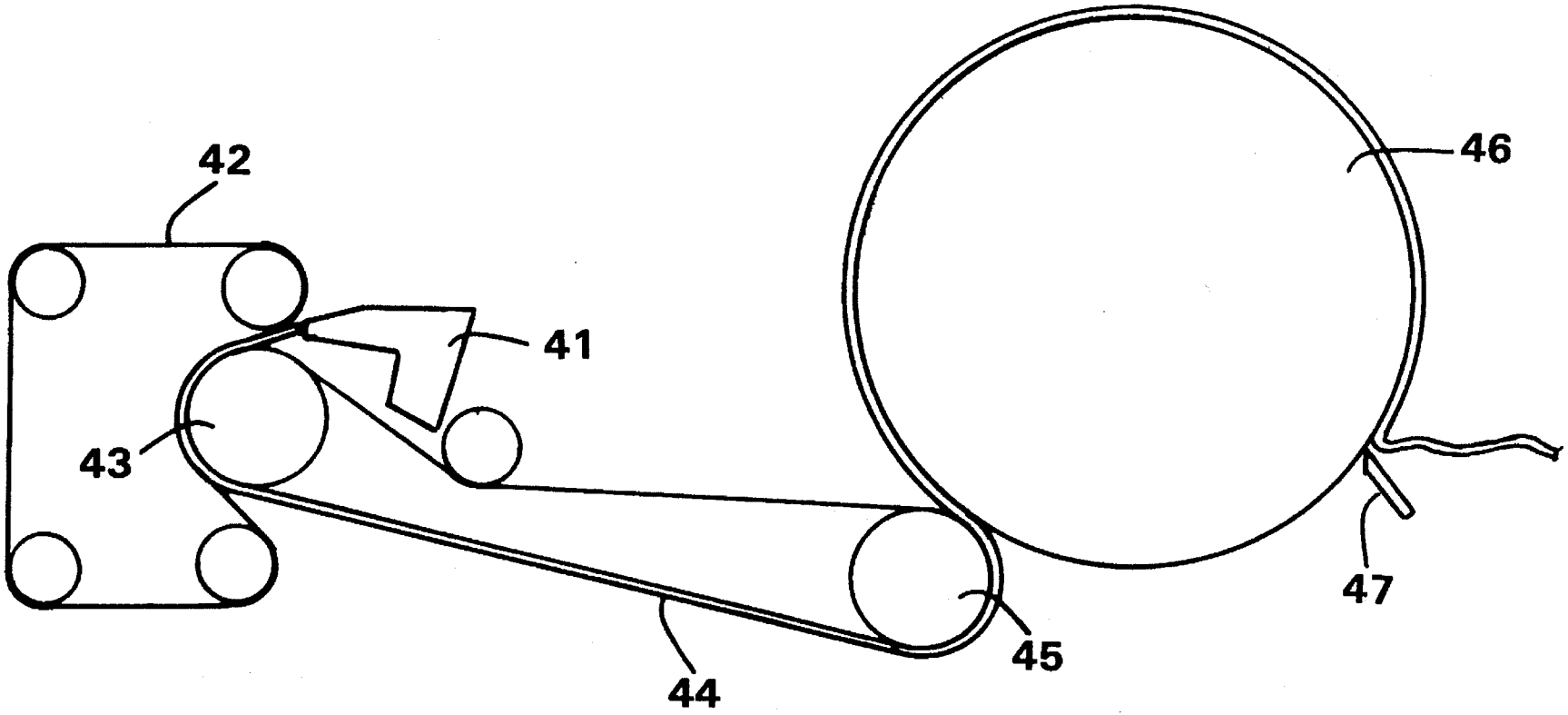
FIG. 2 is a schematic flow diagram of a wet-pressing tissue making process also useful in the practice of this invention, in which a layered tissue is formed using a layered headbox.

FIG. 2 is a schematic flow diagram of a typical wet-pressing tissue making process suitable for use in accordance with this invention. Shown is a layered headbox 41, a forming fabric 42, a forming roll 43, a papermaking felt 44, a press roll 45, a Yankee dryer 46, and a creping blade 47. Also shown, but not numbered, are various idler or tension rolls used for defining the fabric runs in the schematic diagram, which may differ in practice. In operation, a layered headbox 41 continuously deposits a layered stock jet between the forming fabric 42 and the felt 44, which is partially wrapped around the forming roll 43. Water is removed from the aqueous stock suspension through the forming fabric by centrifugal force as the newly-formed web traverses the arc of the forming roll. As the forming fabric and felt separate, the wet web stays with the felt and is transported to the Yankee dryer.

At the Yankee dryer, the creping chemicals are continuously applied on top of the existing adhesive in the form of an aqueous solution. The solution is applied by any convenient means, preferably using a spray boom which evenly sprays the surface of the dryer with the creping adhesive solution. The point of application on the surface of the dryer is immediately following the creping doctor blade, permitting sufficient time for the spreading and drying of the film of fresh adhesive.

The wet web is applied to the surface of the dryer by means of a pressing roll with an application force of about 200 pounds per square inch (psi). The incoming wet web is nominally about 10 percent consistency (range from about 8 to about 20 percent) at the time it reaches the pressure roll. Following the pressing or dewatering step, the consistency of the web is at or above about 30 percent. Sufficient Yankee dryer steam power and hood drying capability are applied to this web to reach a final moisture content of 3 percent or less, preferably 2.5 percent or less. The sheet or web temperature immediately preceding the creping blade, as measured by an infra-red temperature sensor, is preferably about 235° F.

Figure 3:
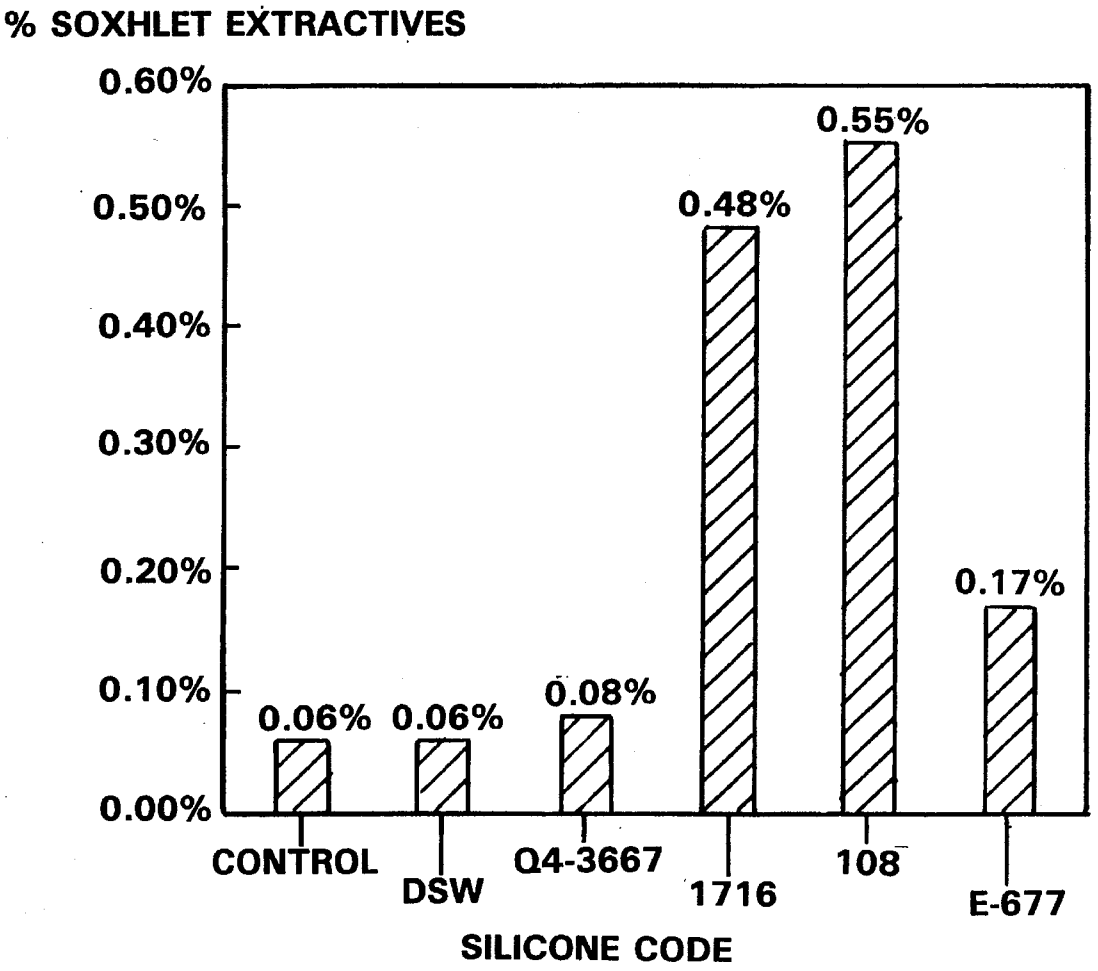
FIG. 3 is a bar graph of the results of a handsheet study on the retention of various silicones by cellulosic papermaking fibers, illustrating the greater retention of cationic silicones.

FIG. 3 is a bar graph illustrating the retention of various types of silicones by cellulosic papermaking fibers as described in the handsheet study hereinafter described in Example 1, illustrating the significantly higher retention of the cationic silicones. Shown is the percent Soxhlet extractives as a function of the particular silicone as identified by the silicone code. As indicated by the bar graph, the cationic silicones (1716 and 108) had significantly higher retention values than the other silicones tested.

Figure 4:
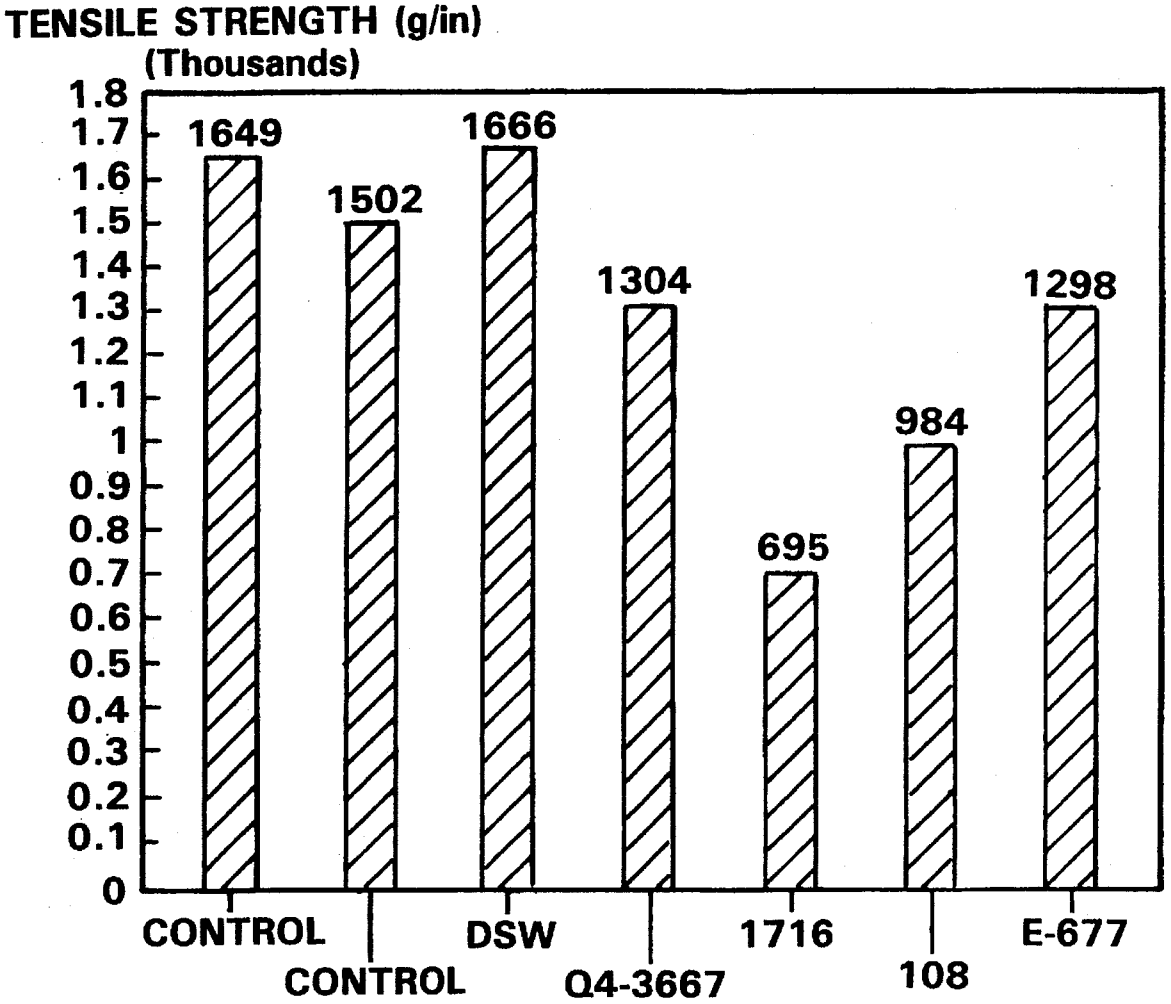
FIG. 4 is a bar graph of the results of the handsheet study on the retention of the silicones, illustrating the impact of the silicones on the strength of the handsheets.

FIG. 4 is a bar graph showing the impact of the silicones described above on the tensile strength of the handsheets. The silicones with cationic emulsions and the highest Soxhlet extractives ("1716" and "108") had the greatest impact on handsheet tensile. The "1716" silicone had a 58% reduction in tensile strength. The non-ionic "DSW" showed no significant change in tensile.

Figure 5:
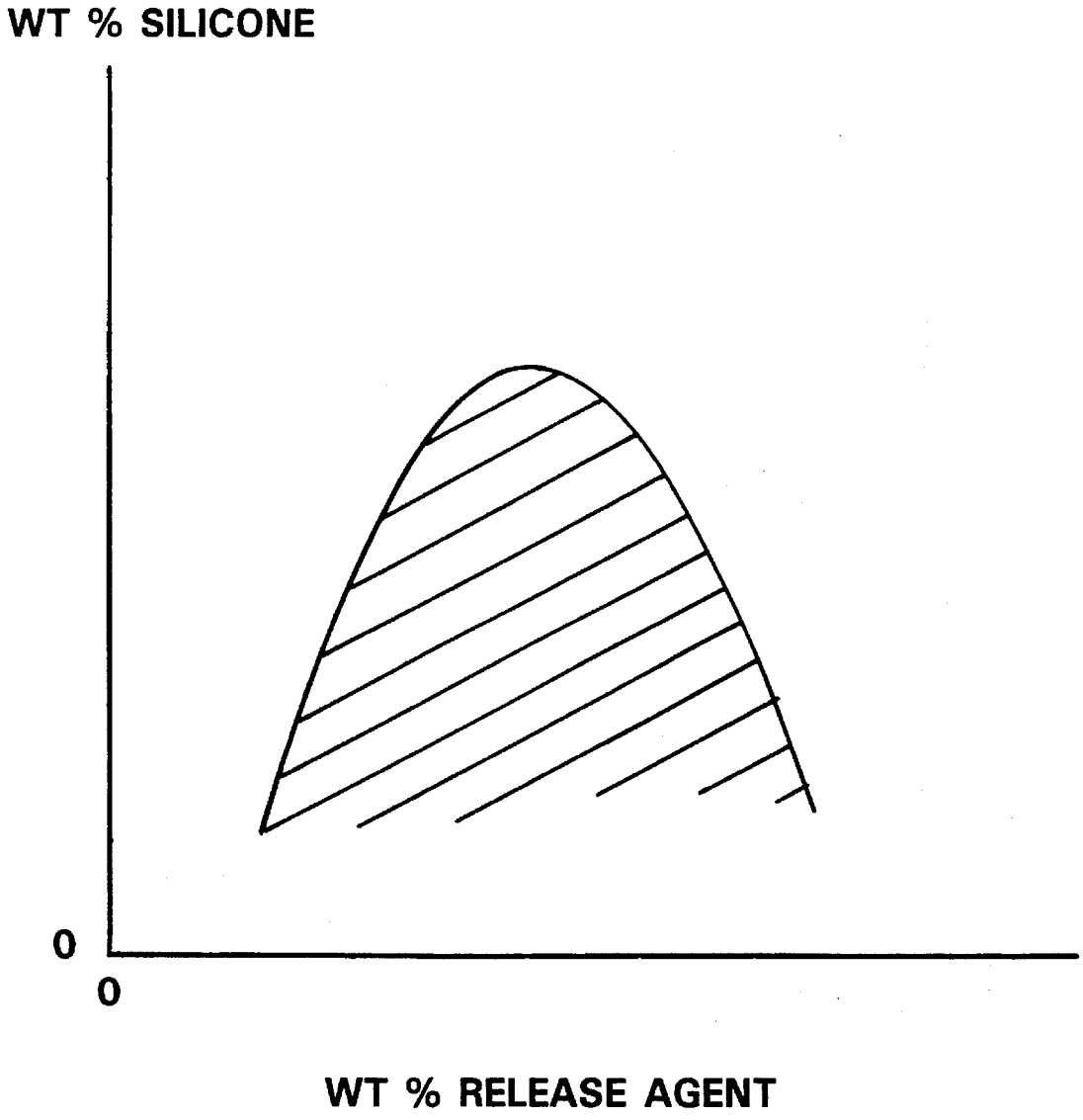
FIG. 5 is a schematic graph of the amount of silicone versus the amount of release agent in the creping adhesive formulation, illustrating the operating window available for balancing the amounts of both chemicals.

FIG. 5 is a schematic graph plotting the concentration of cationic silicone in the fibers that contact the creping cylinder as a function of the concentration of the release agent in the creping adhesive composition, illustrating the operating window (the shaded portion under the curve) in which the creping function is effective. It is believed that the cationic silicone performs like a release agent, necessitating adjustments to achieve a proper balance between the two chemicals. As shown, at very high levels of cationic silicone addition, believed to be above about 1 dry weight percent based on the weight of the fibers to which the silicone is added, adequate creping cannot be achieved regardless of the amount of release agent in the creping adhesive formulation. At lower levels of cationic silicone addition, the area of the graph to the left of the operating window represents an area in which skulch is formed on the dryer surface due to excessive adhesion. The area to the right of the operating window represents an area in which the sheet flares off of the dryer due to inadequate adhesion. As shown, at high levels of release agent adequate creping also cannot be achieved.

While the precise shape of the operating window is not known, there is room under these limits to balance and optimize the amounts of the silicone and the release agent.

EXAMPLES

Example 1.

A handsheet study was carried out to evaluate the effect of different silicones on the physical and tactile properties of various fiber types (eucalyptus, dispersed eucalyptus, and maple BCTMP). In preparing the handsheets, a stock slurry of 50 bone dry grams (g) of fiber and 1950 g of distilled water was prepared for each code. The slurry was then beaten in a British Pulp Disintegrator at 3000 rpm for five minutes. The resulting slurry was made up to 8 liters with distilled water. A 0.5% active silicone solution was prepared and 1.81 weight percent active silicone, based on the weight of the fibers, was added to the slurry. The mixture was allowed to sit for 10 minutes before proceeding. 450 milliliters of this well-mixed slurry was used for making a 8.5 inches×8.5 inches handsheet in a Valley Ironwork mold. Handsheets were couched off the screen, placed in the press with blotter sheets, and pressed at a pressure of 75 pounds per square inch for one minute, dried over a steam dryer for two minutes, and finally dried in an oven at about 60°–70° C. to a constant weight (60 grams per square meter, bone dry). The handsheets were cut to 7.5 inches square. The handsheets were then conditioned for at least 48 hours in a room maintained at a constant relative humidity and at a constant temperature in accordance with TAPPI 402. Ten standard handsheets were produced for each code.

The handsheet study evaluated several different silicones: "Softener DSW" was an epoxy-substituted polysiloxane in the form of a nonionic aqueous emulsion having a pH of 7, available from Dow Corning, Midland, Mich. "Q4-3667" was copolymer silicone fluid, available from Dow Corning. "1716 Micro-Emulsion" was a cationic silanol-substituted polysiloxane emulsion having a pH of 5.7, available from Dow Corning. "108 Emulsion" was a cationic amino-substituted polysiloxane emulsion having a pH of 4.5–5.5, available from Dow Corning. "E-677 Emulsion" was a nonionic amino-substituted polysiloxane emulsion, available from Wacker Silicones Corporation, Adrian, Mich.

Changes in percent extractives (FIG. 3) by Soxhlet extraction and tensile strength (FIG. 4) indicate that the cationic emulsions, Dow Corning's "108 Emulsion" and "1716 Micro-Emulsion", were the best candidates to achieve adequate retention in the wet end of a tissue machine. This supports the retention mechanism requiring a charge difference between the silicone emulsion (cationic) and fiber (anionic).

To further evaluate various silicone materials for making tissue, several tissue prototypes were produced (Examples 2–7) on a small scale continuous pilot machine configured as shown in FIG. 1. This machine formed two separate tissue sheets and couched them together into a single sheet which was then pressed, dried and creped. This configuration allowed simulation of a layered tissue sheet with very high layer purity. Each former had its own stock system including stock chest, metering pump, fan pump and whitewater handling. This allowed each layer to have its own fiber blend and independent chemical treatment. The chemicals could be added to the chest to create a single batch at one concentration or metered into the stock line to allow periodic adjustment.

Example 2.

Dow Corning "Softener DSW" was added in an amount equivalent to 12 lbs/MT (0.54%) to the air side stock chest containing maple BCTMP at approximately 0.8% consistency. The dryer side stock chest contained a northern softwood kraft fiber (LL19). A layered tissue sheet was produced containing 50% silicone-treated maple BCTMP and 50% untreated softwood. The untreated softwood was run on the dryer side. A dry strength starch (RediBond 2005 from National Starch and Chemical company) was added to the softwood side stock pump to control tensile strengths. The tissue sheet was plied up with the hardwood on the outside. Subsequent testing indicated no tactile improvement compared to controls produced with 50% untreated maple BCTMP and 50% northern softwood kraft fiber.

Example 3.

Dow Corning "Q4-3667" was added in an amount equivalent to 10 lbs/MT (0.45%) to the air side stock chest containing dispersed eucalyptus fiber at approximately 0.8% consistency. The dryer side stock chest contained a softwood fiber (LL19). A layered tissue sheet was produced containing 50% silicone-treated dispersed eucalyptus and 50% untreated softwood. The untreated softwood was run on the dryer side. A dry strength starch (RediBond 2005) was added to the softwood side stock pump to control tensile strengths to target. Observations included an increase in basis weight when the silicone was added. This is an indirect indication that the silicone was being retained in the sheet. (Other cationic chemicals also create this effect when first added as the charged molecules function as a retention aid). The tissue sheet was plied up with the hardwood on the outside. Subsequent testing indicated a tactile improvement compared to controls produced with 50% untreated dispersed eucalyptus and 50% untreated softwood.

Example 4.

Dow Corning "Q4-3667" was added in an amount equivalent to 10 lbs/MT (0.45%) to the dryer side stock chest containing dispersed eucalyptus fiber at approximately 0.8% consistency. The air side stock chest contained a softwood fiber (LL19). A layered tissue sheet was produced containing 50% silicone-treated dispersed eucalyptus and 50% untreated softwood. The treated hardwood was run on the dryer side. A dry strength starch (RediBond 2005) was added to the softwood side stock pump to control tensile strengths to target. There was a minor deterioration in crepe quality indicating that silicone was present in the web. The tissue sheet was plied up with the hardwood on the outside. Subsequent testing indicated a tactile improvement compared to controls.

Example 5.

Dow Corning's "1716 Microemulsion" was added in an amount equivalent to 10 lbs/MT (0.45%) to the dryer side stock chest containing dispersed eucalyptus fiber at approximately 0.8% consistency. The air side stock chest contained a softwood fiber (LL19). A layered tissue sheet was produced containing 50% silicone-treated dispersed eucalyptus and 50% untreated softwood. A dry strength starch (RediBond 2005) was added to the softwood side stock pump to control tensile strengths to target. There was a minor deterioration in crepe quality indicating that silicone was present in the web. The tissue sheet was plied up with the hardwood on the outside. Subsequent testing indicated a tactile improvement compared to controls.

Example 6.

Dow Corning "1716 Microemulsion" was added in an amount equivalent to 30 lbs/MT (1.36%) to the dryer side stock chest containing dispersed eucalyptus fiber at approximately 0.8% consistency. The air side stock chest contained a softwood fiber (LL19). A layered tissue sheet was produced containing 50% silicone-treated dispersed eucalyptus and 50% untreated softwood. There was rapid deterioration in crepe quality within a few minutes after the silicone was introduced into the stock system. The resulting sheet possessed no crepe and a very stiff sheet similar to a machine-glazed paper produced for other purposes. The absence of stretch precluded conversion into a two-ply product.

Example 7.

Dow Corning "108 Emulsion" was added in an amount equivalent to 10 lbs/MT (0.45%) to the dryer side stock chest containing dispersed eucalyptus fiber at approximately 0.8% consistency. The air side stock chest contained a softwood fiber (LL19). A layered tissue sheet was produced containing 50% silicone-treated dispersed eucalyptus and 50% untreated softwood. The treated hardwood was run on the dryer side. A dry strength starch (RediBond 2005) was added to the softwood side stock pump to control tensile strengths to target. At 10 lbs/MT, the "108 Emulsion" did result in eventual poor profile and uneven dryer coating after several rolls indicating that silicone was present in the web. The tissue sheet was plied up with the hardwood on the outside. Subsequent testing indicated a tactile improvement compared to controls.

Further testing of the addition of silicones was carried out as described in Examples 8–14 using a crescent former, wet-press machine as illustrated in FIG. 2. For all of the following examples, a wet strength agent (Kymene 557LX) was added at about 5 pounds per metric ton. It was split about equally between the long and short fiber. The "pounds per metric ton" calculation is based on the dryer basis weight of the entire sheet even though in many cases the chemical was only added to a portion of the sheet. In all cases, the silicone was a cationic silicone (Dow Corning 108 Emulsion).

Example 8.

A silicone emulsion was added to a hardwood stock layer (dryer side layer) at 0.16 dry weight percent based on the fiber weight in the hardwood layer. The silicone was added to the thick stock on a batch basis before dilution prior to the headbox. A dry strength agent (Parez 631 available from American Cyanamid) was added to a softwood stock layer (air side layer) at about 0.125 weight percent. The dry strength agent was added to the thick stock on a continuous basis before dilution prior to the headbox. In this example the dry strength agent was added at the same level as the control which contained no silicone. The creping adhesive contained 40% polyvinyl alcohol, 40% Kymene 557LX and 20% Quaker 2008 release agent, which was identical to the control. This tissue exhibited substantial improvements in tactile properties compared to the control.

Example 9.

The silicone was added as described in Example 8, except at 0.08 weight percent. The creping adhesive composition ratio was also changed to 45/45/10. The dry strength agent had to be increased to about 0.25 weight percent because with less release agent the creping blade did not ride deep enough in the coating and strength degradation was greater. Softness was not greatly improved. The lack of softness improvement is believed to be due to the change in creping adhesive composition coupled with low silicone levels compared to Example 8.

Example 10.

The silicone was added as described in Example 8, except at 0.32 weight percent. The creping adhesive composition ratio was also changed to 80/20/0. Dry strength was increased to about 0.5 weight percent because with no release agent the creping blade did not ride deep enough in the coating and strength degradation was greater. Softness was slightly improved. The lack of substantial softness improvement is believed to be due to the deviation from optimum creping conditions compared to Example 8. There was, however, enough silicone on the tissue to overcome the negative effects of improper creping.

Example 11.

The silicone was added as described in Example 8 at 0.16 weight percent. The dryer basis weight was reduced from 7.0 pounds per 2880 square feet. (Example 8) to 5.0 pounds per 2880 square feet. The creping adhesive composition ratio was changed to 45/45/10. Dry strength was increased from 0.7 percent to 0.8 percent compared to the control. Softness was not greatly improved. The lack of softness improvement is believed to be due to the departure from the optimum creping conditions, which are believed to be different for the 5 pound sheet used in this example compared to the 7 pound sheet used in Example 8.

Example 12.

For this example the long fiber and short fiber were mixed prior to dilution before the headbox. The headbox divider that normally separates the long and short fiber furnishes was left in place but served no functional purpose. The dryer basis weight was 5.0 pounds per 2880 square feet compared to 7.0 in Example 8. Silicone was added to the short fibers at 0.08 weight percent before mixing with the long fibers. Dry strength agent was added to the long fiber at about 0.6 percent before mixing with the short fiber compared to 0.5 percent for the control. The creping adhesive composition ratio was also changed to 45/45/10. Softness was improved, illustrating that the cationic silicone addition can improve the softness of blended (non layered) sheets.

Example 13.

For this example the long fiber and short fiber were mixed prior to dilution before the headbox. The divider that normally separates the long and short fiber layers was left in place but it served no functional purpose. The dryer basis weight was 5.0 pounds per 2880 square feet compared to 7.0 in Example 8. Silicone was added to the short fiber at 0.32 weight percent before mixing with the long fiber. Dry strength was added to the long fiber at about 0.8 percent before mixing with the short fiber compared to 0.5 percent for the control. The creping adhesive composition ratio was also changed to 50/50/0. Softness was improved compared to Example 12. Increasing the silicone addition resulted in improved softness even though creping conditions may not have been optimum.

It will be appreciated that the foregoing examples, given for purposes of illustration, are not to be construed as limiting the scope of this invention, which is defined by the following claims and all equivalents thereto.

I claim:

1. A method of making a soft tissue sheet comprising the steps of: (a) forming an aqueous suspension of cellulosic papermaking fibers containing from about 0.01 to about 1 dry weight percent, based on the weight of the fibers, of a cationic silicone; (b) depositing the aqueous suspension onto a foraminous forming wire which retains the fibers to form a wet web; (c) dewatering or dewatering/drying the wet web; (d) adhering the web to a creping cylinder with a creping adhesive and (e) creping the web from the creping cylinder with a creping blade to form a soft tissue.

2. The method of claim 1 wherein the amount of cationic silicone is from about 0.05 to about 0.5 dry weight percent.

3. The method of claim 1 wherein the amount of cationic silicone is from about 0.1 to about 0.2 dry weight percent.

4. The method of claim 1 wherein the creping adhesive comprises from about 20 to about 60 dry weight percent polyvinyl alcohol, from about 20 to about 60 dry weight percent of a thermosetting cationic polyamide resin, and from about 15 to about 25 weight percent of a quaternized polyamino amide release agent.

5. The method of claim 1 wherein the web is dried to a moisture content of about 3 percent or less at the creping blade.

6. The method of claim 1 wherein the papermaking fibers are hardwood fibers which are subsequently deposited onto the forming wire as an outer layer of the tissue web.

7. The method of claim 6 wherein the hardwood layer is placed against the surface of the creping cylinder during creping.

8. The method of claim 1 wherein the silicone is a polysiloxane.

9. The method of claim 1 wherein the wet web is dewatered by wet-pressing and adhered to a Yankee dryer.

10. The method of claim 1 wherein the wet web is throughdried and thereafter adhered to a creping cylinder.

* * * * *